US009970261B2

(12) United States Patent
Tolman et al.

(10) Patent No.: US 9,970,261 B2
(45) Date of Patent: May 15, 2018

(54) FLOW CONTROL ASSEMBLIES FOR DOWNHOLE OPERATIONS AND SYSTEMS AND METHODS INCLUDING THE SAME

(71) Applicants: Randy C. Tolman, Spring, TX (US); Timothy G. Benish, Conroe, TX (US); Geoffrey F. Steiner, Castle Rock, CO (US)

(72) Inventors: Randy C. Tolman, Spring, TX (US); Timothy G. Benish, Conroe, TX (US); Geoffrey F. Steiner, Castle Rock, CO (US)

(73) Assignee: ExxonMobil Upstream Research Company, Spring, TX (US)

( * ) Notice: Subject to any disclaimer, the term of this patent is extended or adjusted under 35 U.S.C. 154(b) by 196 days.

(21) Appl. No.: 14/435,392

(22) PCT Filed: Nov. 26, 2013

(86) PCT No.: PCT/US2013/072027
§ 371 (c)(1),
(2) Date: Apr. 13, 2015

(87) PCT Pub. No.: WO2014/099306
PCT Pub. Date: Jun. 26, 2014

(65) Prior Publication Data

US 2015/0285029 A1 Oct. 8, 2015

Related U.S. Application Data

(60) Provisional application No. 61/745,136, filed on Dec. 21, 2012, provisional application No. 61/834,296,
(Continued)

(51) Int. Cl.
*E21B 34/12* (2006.01)
*E21B 43/12* (2006.01)
(Continued)

(52) U.S. Cl.
CPC ..... *E21B 34/12* (2013.01); *E21B 34/10* (2013.01); *E21B 43/11* (2013.01); *E21B 43/12* (2013.01);
(Continued)

(58) Field of Classification Search
CPC ..... E21B 34/007; E21B 34/12
See application file for complete search history.

(56) References Cited

U.S. PATENT DOCUMENTS 5,234,055 A 8/1993 Cornette
5,579,844 A 12/1996 Rebardi et al.
(Continued)

OTHER PUBLICATIONS

Schlumberger Limited, "Falcon Hydraulic-Actuated Frac Valve," 2012, http://www.slb.com/resources/other_resources/product_sheets/completions/multistage_stimulation/hydraulic_actuated_frac_valve_ps.aspx.

*Primary Examiner* — Giovanna C. Wright
*Assistant Examiner* — Manuel C Portocarrero
(74) *Attorney, Agent, or Firm* — ExxonMobil Upstream Research Company—Law Department

(57) ABSTRACT

Flow control assemblies for downhole operations and systems and methods including the same are disclosed herein. The systems include a flow control assembly that is configured to control a fluid flow between a casing conduit and a subterranean formation. The flow control assembly includes a housing that includes a housing body that defines at least a portion of the casing conduit. The housing also includes an injection conduit, which extends between the casing conduit and the subterranean formation, and a ball sealer seat, which defines a portion of the injection conduit. The flow control assembly further includes a hydraulically actuated sliding sleeve that controls a fluid flow through the injection conduit. The methods include pressurizing a portion of the casing conduit, transitioning the hydraulically actuated slid-
(Continued)

ing sleeve from a closed configuration to an open configuration, stimulating the subterranean formation, and receiving a ball sealer on the ball sealer seat.

26 Claims, 7 Drawing Sheets

Related U.S. Application Data filed on Jun. 12, 2013, provisional application No. 61/894,302, filed on Oct. 22, 2013.

(51) Int. Cl.

| | |
|---|---|
| ***E21B 34/10*** | (2006.01) |
| ***E21B 43/11*** | (2006.01) |
| ***E21B 43/26*** | (2006.01) |
| ***E21B 34/00*** | (2006.01) |

(52) U.S. Cl.

CPC ..... *E21B 43/26* (2013.01); *E21B 2034/007* (2013.01)

(56) References Cited

U.S. PATENT DOCUMENTS

| | | | | |
|---|---|---|---|---|
| 5,595,206 | A * | 1/1997 | Soria Vega | F16K 27/067 137/15.22 |
| 5,704,426 | A | 1/1998 | Rytlewski et al. | |
| 5,829,520 | A | 11/1998 | Johnson | |
| 6,543,538 | B2 | 4/2003 | Tolman et al. | |
| 6,907,936 | B2 | 6/2005 | Fehr et al. | |
| 6,957,701 | B2 | 10/2005 | Tolman et al. | |
| 7,059,407 | B2 | 6/2006 | Tolman et al. | |
| 7,168,494 | B2 | 1/2007 | Starr et al. | |
| 7,353,879 | B2 | 4/2008 | Todd et al. | |
| 7,477,160 | B2 | 1/2009 | Lemenager et al. | |
| 7,516,792 | B2 | 4/2009 | Lonnes et al. | |
| 7,575,062 | B2 | 8/2009 | East, Jr. | |
| 7,735,559 | B2 | 6/2010 | Malone | |
| 7,798,236 | B2 | 9/2010 | McKeachnie et al. | |
| 8,167,047 | B2 | 5/2012 | Themig et al. | |
| 8,215,411 | B2 | 7/2012 | Flores et al. | |
| 8,220,542 | B2 | 7/2012 | Whitsitt et al. | |
| 8,237,585 | B2 | 8/2012 | Zimmerman | |
| 8,267,177 | B1 | 9/2012 | Vogel et al. | |
| 8,276,670 | B2 | 10/2012 | Patel | |
| 8,330,617 | B2 | 12/2012 | Chen et al. | |
| 8,347,982 | B2 | 1/2013 | Hannegan et al. | |
| 8,496,055 | B2 | 7/2013 | Mootoo et al. | |
| 2002/0007949 | A1 | 1/2002 | Tolman et al. | |
| 2004/0084190 | A1 | 5/2004 | Hill et al. | |
| 2006/0118301 | A1 | 6/2006 | East, Jr. et al. | |
| 2008/0093073 | A1 | 4/2008 | Bustos et al. | |
| 2009/0032255 | A1 | 2/2009 | Surjaatmadja et al. | |
| 2009/0101334 | A1 | 4/2009 | Baser et al. | |
| 2010/0084134 | A1 | 4/2010 | Tulissi et al. | |
| 2011/0048743 | A1 | 3/2011 | Stafford et al. | |
| 2011/0168403 | A1 | 7/2011 | Patel | |
| 2011/0266472 | A1 * | 11/2011 | Russell | E21B 21/106 251/28 |
| 2012/0043079 | A1 | 2/2012 | Wassouf et al. | |
| 2012/0085548 | A1 | 4/2012 | Fleckenstein et al. | |
| 2012/0090687 | A1 | 4/2012 | Grigsby et al. | |
| 2012/0111566 | A1 | 5/2012 | Sherman et al. | |
| 2012/0181032 | A1 * | 7/2012 | Naedler | E21B 43/26 166/308.1 |
| 2012/0199349 | A1 | 8/2012 | Themig et al. | |
| 2012/0292053 | A1 | 11/2012 | Xu et al. | |
| 2013/0008648 | A1 | 1/2013 | Lovorn et al. | |
| 2013/0105159 | A1 | 5/2013 | Alvarez et al. | |
| 2013/0199790 | A1 | 8/2013 | Themig et al. | |
| 2013/0206425 | A1 | 8/2013 | Mazyar et al. | |
| 2013/0248174 | A1 | 9/2013 | Dale et al. | |

* cited by examiner

FLOW CONTROL ASSEMBLIES FOR DOWNHOLE OPERATIONS AND SYSTEMS AND METHODS INCLUDING THE SAME

CROSS-REFERENCE TO RELATED APPLICATIONS

This application is the National Stage of International Application No. PCT/US2013/072027, filed Nov. 26, 2013, which claims the benefit of U.S. Provisional Patent Application No. 61/745,136, filed Dec. 21, 2012, U.S. Provisional Patent Application No. 61/834,296, filed Jun. 12, 2013, and U.S. Provisional Patent Application No. 61/894,302, filed Oct. 22, 2013, the complete disclosure of each is hereby incorporated by reference.

FIELD OF THE DISCLOSURE

The present disclosure is directed generally to flow control assemblies for downhole operations, and more particularly to flow control assemblies that include a housing, which includes and/or defines an injection conduit and a ball sealer seat, and a hydraulically actuated sliding sleeve, which selectively regulates fluid flow through the injection conduit.

BACKGROUND OF THE DISCLOSURE

A well, such as a hydrocarbon well and/or an oil well, may include a casing string that defines a casing conduit and extends between a surface region and a subterranean formation. During construction and/or operation of the well, it may be desirable to perform any one of a number of downhole operations. Illustrative, non-exclusive examples of these downhole operations include locating one or more downhole tools within the casing conduit, stimulating at least a portion of the subterranean formation, fluidly isolating an uphole portion of the casing conduit from a downhole portion of the casing conduit, and/or fluidly isolating the casing conduit from the subterranean formation.

These downhole operations may utilize one or more flow control assemblies to control fluid flows within the casing conduit and/or between the casing conduit and the subterranean formation. However, current flow control assemblies may not provide a desired level of operational flexibility and/or may be costly to install, utilize, and/or remove from the casing conduit. Thus, there exists a need for improved flow control assemblies for downhole operations.

SUMMARY OF THE DISCLOSURE

Flow control assemblies for downhole operations are disclosed herein, as are systems and methods including the same. The systems include a flow control assembly that is configured to control a fluid flow between a casing conduit and a subterranean formation. The flow control assembly includes a housing that includes a housing body that defines at least a portion of the casing conduit. The housing also includes an injection conduit, which extends between the casing conduit and the subterranean formation, and a ball sealer seat, which defines a portion of the injection conduit. The flow control assembly further includes a hydraulically actuated sliding sleeve that is configured to transition between a closed configuration and an open configuration responsive to a pressure differential to control an injection conduit fluid flow through the injection conduit.

In some embodiments, the pressure differential includes a pressure differential between the casing conduit and the subterranean formation. In some embodiments, the sliding sleeve is located within the casing conduit. In some embodiments, the sliding sleeve fluidly isolates the ball sealer seat from the casing conduit when the sliding sleeve is in the closed configuration. In some embodiments, the sliding sleeve is external to the casing conduit. In some embodiments, the assembly further includes a retention structure that is configured to retain the sliding sleeve in the closed configuration and to selectively permit the sliding sleeve to transition to the open configuration responsive to the pressure differential.

In some embodiments, the injection conduit is sized to permit stimulation of the subterranean formation by the injection conduit fluid flow. In some embodiments, the injection conduit is sized to maintain at least a threshold pressure drop thereacross when the injection conduit fluid flow of a stimulant fluid flows therethrough.

In some embodiments, the flow control assembly includes a plurality of injection conduits and a plurality of corresponding ball sealer seats. In some embodiments, the ball sealer seat defines a ball sealer sealing surface that is configured to form a fluid seal with a ball sealer. In some embodiments, the ball sealer seat is a machined ball sealer seat. In some embodiments, a material composition of the ball sealer seat is different from a material composition of the housing body.

In some embodiments, the flow control assembly may form a portion of a casing string. In some embodiments, the casing string may include a plurality of flow control assemblies. In some embodiments, the casing string may extend within a wellbore and/or may form a portion of a hydrocarbon well.

The methods include pressurizing a portion of the casing conduit to generate a pressurized region within the casing conduit. The methods further include transitioning the hydraulically actuated sliding sleeve from the closed configuration to the open configuration responsive to the pressure differential exceeding a threshold pressure differential. The methods then include stimulating the subterranean formation by flowing the stimulant fluid through the injection conduit and into the subterranean formation as the injection conduit fluid flow. The methods also include receiving a ball sealer on the ball sealer seat to restrict the injection conduit fluid flow.

In some embodiments, the transitioning includes translating the sliding sleeve within the casing conduit. In some embodiments, the transitioning includes translating the sliding sleeve along an outer surface of the flow control assembly. In some embodiments, the pressurizing includes providing the stimulant fluid to the casing conduit.

In some embodiments, the methods further include producing a reservoir fluid from the subterranean formation. In some embodiments, the methods further include repeating the methods to stimulate another portion of the subterranean formation.

DETAILED DESCRIPTION AND BEST MODE OF THE DISCLOSURE

Figure 1:
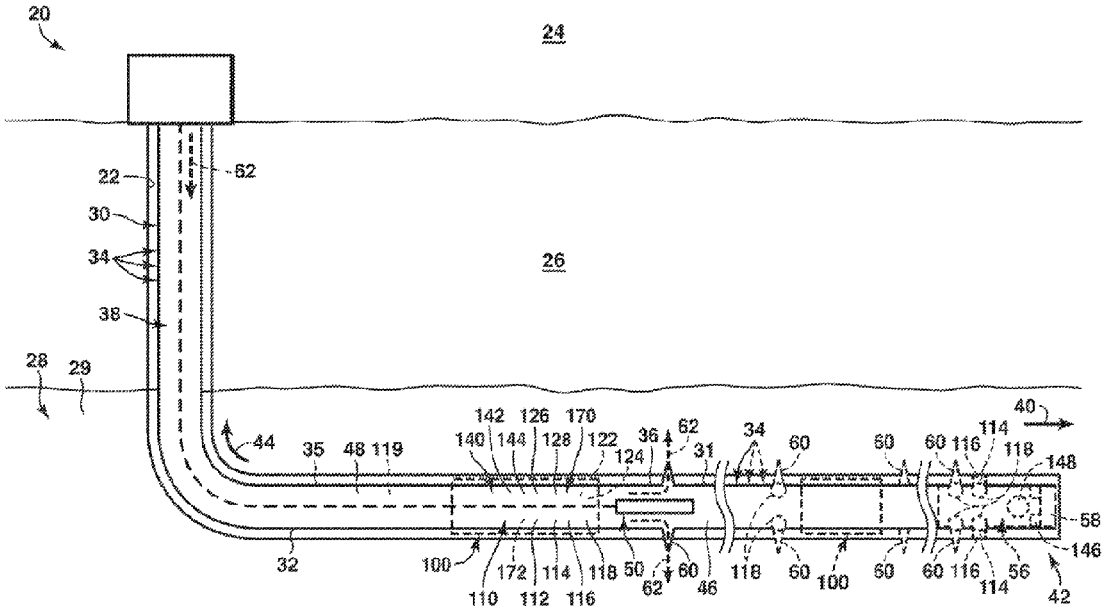
FIG. 1 is a schematic representation of illustrative, non-exclusive examples of a hydrocarbon well that may include the systems and/or be utilized with the systems and methods according to the present disclosure.

FIGS. 1-12 provide illustrative, non-exclusive examples of flow control assemblies 100 according to the present disclosure, of components of flow control assemblies 100, and/or of casing strings 30 and/or hydrocarbon wells 20 that may include and/or utilize flow control assemblies 100. Elements that serve a similar, or at least substantially similar, purpose are labeled with like numbers in each of FIGS. 1-12, and these elements may not be discussed in detail herein with reference to each of FIGS. 1-12. Similarly, all elements may not be labeled in each of FIGS. 1-12, but reference numerals associated therewith may be utilized herein for consistency. Elements, components, and/or features that are discussed herein with reference to one or more of FIGS. 1-12 may be included in and/or utilized with any of FIGS. 1-12 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic representation of illustrative, non-exclusive examples of a hydrocarbon well 20 that may be utilized with and/or include the systems and methods according to the present disclosure. Hydrocarbon well 20 includes, defines, and/or is associated with a wellbore 22, which extends between a surface region 24 and a subterranean formation 28 that is present within a subsurface region 26. Hydrocarbon well 20 also includes a casing string 30 that extends within wellbore 22 and defines a casing conduit 38 therein.

As illustrated in FIG. 1 and discussed in more detail herein, hydrocarbon well 20 may include (and/or casing conduit 38 may contain) a perforation device 50 that is configured to create one or more perforations 60 within casing string 30. Perforations 60 may permit stimulation of subterranean formation 28, such as by permitting flow of a stimulant fluid 62 from casing conduit 38 into subterranean formation 28. Additionally or alternatively, perforations 60 also may permit production of a reservoir fluid 29 from subterranean formation 28 to surface region 24 via casing conduit 38. Reservoir fluid 29 additionally or alternatively may be referred to herein as, and/or may be, a hydrocarbon 29 and/or a hydrocarbon fluid 29. Perforation device 50 may include and/or define any suitable structure that is configured to create perforations 60. As an illustrative, non-exclusive example, perforation device 50 may include and/or be a perforation gun that includes at least one perforation charge, and optionally a plurality of perforation charges.

As illustrated in dashed lines in FIG. 1 and also discussed in more detail herein, one or more ball sealers 118 may be selectively located within casing conduit 38 and, when present, may prevent a fluid flow through perforations 60 from the casing conduit into the subterranean formation. In addition, and as also illustrated in dashed lines in FIG. 1, casing conduit 38 further may include an isolation device 56, which may be configured to fluidly isolate at least a portion of casing conduit 38 from subterranean formation 28.

Hydrocarbon well 20 and/or wellbore 22, casing string 30, and/or casing conduit 38 thereof may define an uphole direction 44 and a downhole direction 40. Uphole direction 44 may define a direction within and/or along a length of wellbore 22, casing string 30, and/or casing conduit 38 that is directed toward surface region 24. Conversely, downhole direction 40 may define a direction within and/or along a length of wellbore 22, casing string 30, and/or casing conduit 38 that is directed away from surface region 24 and/or toward a terminal end 42 of wellbore 22.

Additionally or alternatively, uphole direction 44 and downhole direction 40 may be relative terms that may be utilized herein to describe a relative location of one portion of hydrocarbon well 20 with respect to another portion of hydrocarbon well 20. As an illustrative, non-exclusive example, and in the illustrative, non-exclusive example of FIG. 1, terminal end 42 may be downhole, or located downhole, from ball sealers 118 and/or from perforation device 50. Similarly, ball sealers 118 and/or perforation device 50 may be uphole, or located uphole, from terminal end 42.

Casing string 30 includes a plurality of lengths of casing 34 and at least one hydraulically actuated flow control assembly 100. As an illustrative, non-exclusive example, casing string 30 may include at least a first length (or portion) 35 of casing 34 that defines a first, or uphole, portion 48 of casing conduit 38, and a second length (or portion) 36 of casing 34 that defines a second, or downhole, portion 46 of casing conduit 38. Hydraulically actuated flow control assembly 100 also may be referred to herein as flow control assembly 100 and may be located between and/or may be operatively attached to first length 35 and second length 36.

It is within the scope of the present disclosure that casing string 30 may include any suitable number of lengths of casing 34 and/or any suitable number of flow control assemblies 100. As illustrative, non-exclusive examples, casing string 30 may include a plurality of lengths of casing 34 and a plurality of flow control assemblies 100, with each flow control assembly 100 being located between a respective pair of lengths of casing 34. As additional illustrative, non-exclusive examples, casing string 30 may include at least 2, at least 3, at least 4, at least 5, at least 6, at least 7, at least 8, at least 9, at least 10, at least 12, at least 14, at least 16, at least 18, at least 20, at least 22, at least 24, at least 26, at least 28, or at least 30 flow control assemblies and/or a corresponding number of respective lengths of casing 34.

Flow control assembly 100 may include any suitable structure that may form a portion of casing sting 30 and/or that may be configured to selectively control a fluid flow between casing conduit 38 and subterranean formation 28. More specific but still illustrative, non-exclusive examples of flow control assemblies 100 according to the present disclosure are illustrated in FIGS. 2-6 and discussed in more detail herein with reference thereto. Illustrative, non-exclusive examples of process flows that may be utilized with hydrocarbon wells 20 that include flow control assemblies 100 according to the present disclosure are illustrated in FIGS. 7-12.

Flow control assemblies 100 may include a housing 110 that includes a housing body 112. As illustrated in FIGS. 1-6, housing body 112 has an inner surface 126, which defines at least a portion of casing conduit 38. The housing body also may have an outer surface 128, which may be opposed to inner surface 126 and/or may be proximal to and/or in direct fluid communication with subterranean formation 28 (when the flow control assembly is present within the subterranean formation).

When flow control assembly 100 is located within casing string 30, housing body 112 may be referred to herein as defining a portion of the casing string and/or as being located within the casing string. As an illustrative, non-exclusive example, housing body 112 may be operatively attached to a first (or downhole) portion 31 of casing string 30 and also to a second (or uphole) portion 32 of casing string 30 via attachment structures 122, which are discussed in more detail herein.

Housing body 112 also defines an injection conduit 114 that extends through the housing body between inner surface 126 and outer surface 128. Thus, when flow control assembly 100 is present within subterranean formation 28, injection conduit 114 extends and/or selectively provides fluid communication between casing conduit 38 and subterranean formation 28. Illustrative, non-exclusive examples of injection conduit 114 are discussed in more detail herein.

Housing 110 (and/or housing body 112 thereof) further includes and/or defines a ball sealer seat 116. Ball sealer seat 116 defines a portion of injection conduit 114 and may be defined on, near, and/or by inner surface 126 of housing 110. Ball sealer seat 116 may be formed with the housing body or separately formed and then secured to the housing body. Ball sealer seat 116 is sized to receive ball sealer 118. When present on ball sealer seat 116, ball sealer 118 restricts fluid flow from casing conduit 38 through injection conduit 114 and into subterranean formation 28. Illustrative, non-exclusive examples of ball sealer seats 116 are discussed in more detail herein with reference to FIG. 6.

Figure 2:
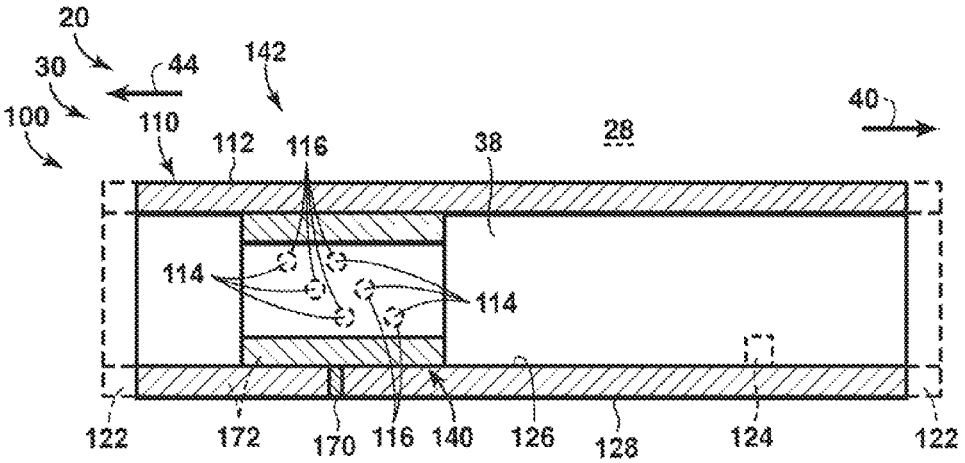
FIG. 2 is a less schematic representation of illustrative, non-exclusive examples of a flow control assembly according to the present disclosure in a closed configuration.
Figure 3:
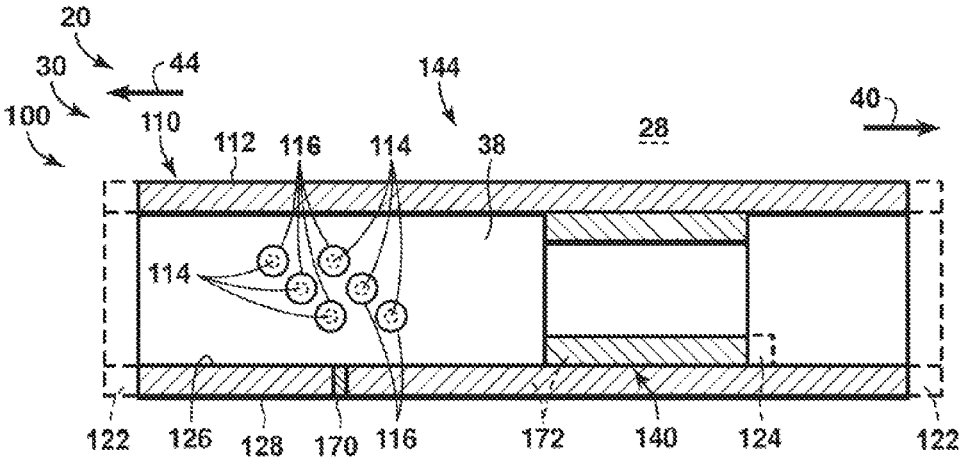
FIG. 3 is a less schematic representation of illustrative, non-exclusive examples of the flow control assembly of FIG. 2 in an open configuration.
Figure 4:
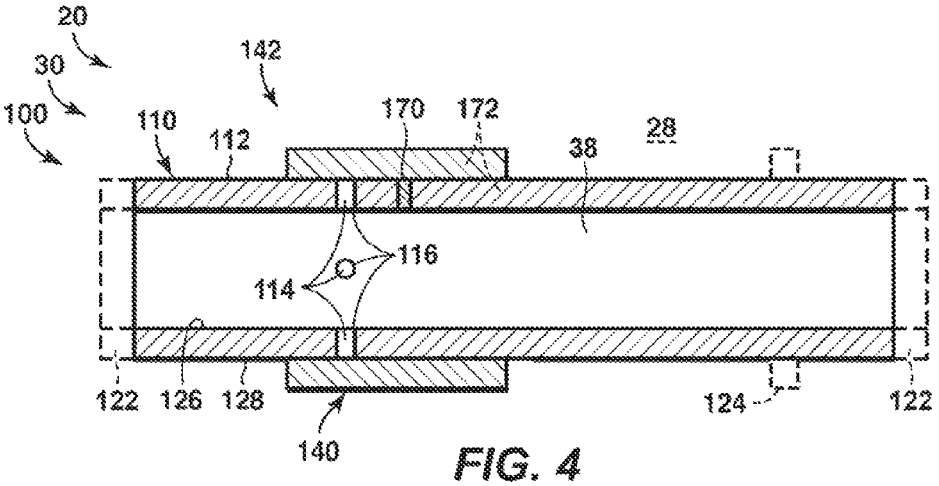
FIG. 4 is a less schematic representation of illustrative, non-exclusive examples of another flow control assembly according to the present disclosure in a closed configuration.
Figure 5:
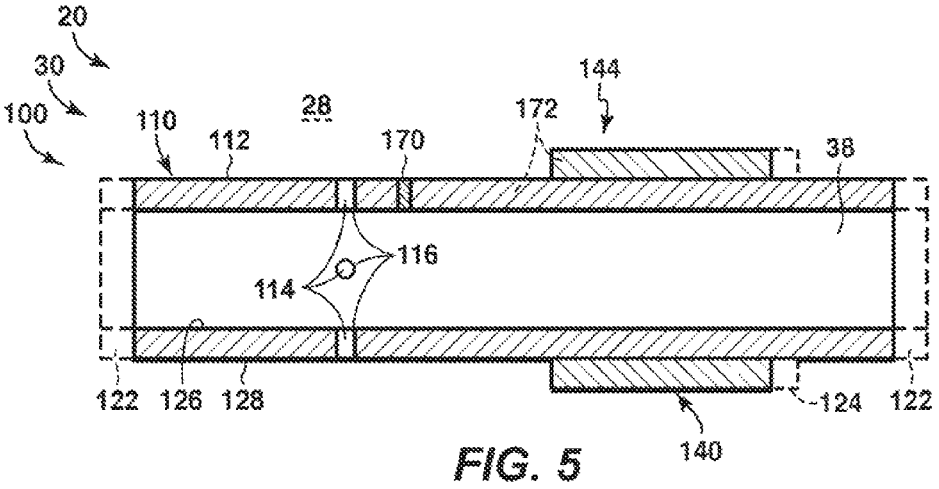
FIG. 5 is a less schematic representation of illustrative, non-exclusive examples of the flow control assembly of FIG. 4 in an open configuration.

Flow control assembly 100 further includes a hydraulically actuated sliding sleeve 140. Hydraulically actuated sliding sleeve 140 also may be referred to herein as sliding sleeve 140 and may be located within casing conduit 38 (as illustrated in FIGS. 2-3) and/or located external to casing conduit 38 (as illustrated in FIGS. 4-5). Sliding sleeve 140 is configured to selectively transition between a closed configuration 142, as illustrated in FIGS. 1-2 and 4, and an open configuration 144, as illustrated in FIGS. 1, 3, and 5, responsive to a pressure differential. When sliding sleeve 140 is in closed configuration 142, flow control assembly 100 also may be referred to herein as being in closed configuration 142. Similarly, and when sliding sleeve 140 is in open configuration 144, flow control assembly 100 also may be referred to herein as being in open configuration 144.

When sliding sleeve 140 is in closed configuration 142, the sliding sleeve resists, blocks, occludes, and/or stops a fluid flow through the injection conduit. Although not required, this fluid flow may be referred to herein as an injection conduit fluid flow. Conversely, when sliding sleeve 140 is in open configuration 144, the sliding sleeve permits, facilitates, allows, and/or provides for the fluid flow through the injection conduit.

The pressure differential may include and/or be any suitable pressure differential that may be defined within hydrocarbon well 20 and/or any suitable portion(s) thereof. As an illustrative, non-exclusive example, the pressure differential may include a pressure differential between subterranean formation 28 and casing conduit 38. As more specific but still illustrative, non-exclusive examples, the pressure differential may be defined between subterranean formation 28 and downhole portion 46 of casing conduit 38, between the subterranean formation and uphole portion 48 of the casing conduit, between the subterranean formation and a portion of the casing conduit that is defined by inner surface 126 of housing body 112, and/or between uphole portion 48 and downhole portion 46. As additional more specific but still illustrative, non-exclusive examples, the pressure differential may include, be, and/or be defined such that a pressure within casing conduit 38 is greater than a pressure within subterranean formation 28 and/or such that a pressure within uphole portion 48 of casing conduit 38 is greater than a pressure within downhole portion 46 of casing conduit 38.

Flow control assembly 100 also may include a retention structure 170. Retention structure 170 may be configured to retain sliding sleeve 140 in the closed configuration and to selectively permit the sliding sleeve to transition to the open configuration responsive to the pressure differential.

As an illustrative, non-exclusive example, retention structure 170 may include and/or be at least one shear pin that may be configured to retain the sliding sleeve in the closed configuration and to permit the sliding sleeve to transition from the closed configuration to the open configuration upon, responsive to, or as a result of, shearing of the shear pin(s). As another illustrative, non-exclusive example, retention structure 170 also may include and/or be a pressure pad that may be configured to retain the sliding sleeve in the closed configuration and to selectively permit the sliding sleeve to transition to the open configuration responsive to motion of, pressure on, and/or fluid pressure on the pressure pad.

It is within the scope of the present disclosure that retention structure 170 (optionally) may be configured to retain sliding sleeve 140 in the open configuration. As such, the sliding sleeve may be configured to be retained in the open configuration subsequent to transitioning thereto.

It is also within the scope of the present disclosure that flow control assembly 100 and/or retention structure 170 thereof may include an optional biasing mechanism 172. Biasing mechanism 172 may be configured to bias the sliding sleeve to the closed configuration. As such, the sliding sleeve may be configured to return to the closed configuration (via a motive force that may be applied by the biasing mechanism) responsive to the pressure differential being less than the threshold pressure differential, responsive to a different pressure differential, and/or responsive to any other suitable system parameter. Additionally or alternatively, biasing mechanism 172 also may be configured to bias sliding sleeve 140 toward the open configuration and/or to retain sliding sleeve 140 in the open configuration subsequent to the sliding sleeve transitioning thereto. Illustrative, non-exclusive examples of biasing mechanism 172 include any suitable spring, compressed fluid, and/or elastomer (or elastomeric material).

In addition, flow control assembly 100 also may include and/or be associated with one or more attachment structures 122 and/or a sleeve stop 124. Attachment structures 122 may include any suitable structure that may be configured and/or designed to operatively attach flow control assembly 100 to respective lengths of casing 34. Sleeve stop 124 may include any suitable structure that is configured to limit a motion of sliding sleeve 140 when the sliding sleeve transitions between the closed configuration and the open configuration, from the closed configuration to the open configuration, and/or from the open configuration to the closed configuration.

As schematically illustrated in dashed lines in FIG. 1, hydrocarbon well 20, and/or casing conduit 38 thereof, also may include one or more supplemental sealing materials 119. Supplemental sealing materials 119 may be located within casing conduit 38 proximal to, in physical contact with, and/or in mechanical contact with ball sealers 118. The supplemental sealing materials may be configured to retain ball sealers 118 on perforations 60 and/or on ball sealer seats 116, may be configured to decrease fluid leakage past ball sealers 118 when ball sealers 118 are located on perforations 60 and/or on ball sealer seats 116, and/or may be configured to seal perforations 60 and/or ball sealer seats 116 that do not have a respective ball sealer 118 associated therewith. Illustrative, non-exclusive examples of supplemental sealing materials 119 include a supplemental ball sealer, a fibrous material, a particulate material, a granular material, cellophane flakes, cotton seed hulls, sawdust, benzoic acid flakes, shaved rock salt, walnut shells, and/or sieve-sided sand.

FIG. 2 is a less schematic representation of illustrative, non-exclusive examples of a flow control assembly 100 according to the present disclosure in closed configuration 142, while FIG. 3 is a less schematic representation of flow control assembly 100 of FIG. 2 in open configuration 144. In FIGS. 2-3, flow control assembly 100 includes a sliding sleeve 140 that is located within casing conduit 38, that is in contact with inner surface 126 of housing body 112, and/or that is located within a portion of casing conduit 38 that is defined by housing body 112.

As such, and when in closed configuration 142, sliding sleeve 140 fluidly isolates injection conduits 114 and/or ball sealer seats 116 from casing conduit 38 (as illustrated in FIG. 2). However, and upon transitioning to open configuration 144, sliding sleeve 140 permits fluid communication between injection conduits 114 (and/or ball sealer seats 116) and casing conduit 38, thereby permitting fluid flow between casing conduit 38 and subterranean formation 28 (as illustrated in FIG. 3).

FIG. 4 is a less schematic representation of illustrative, non-exclusive examples of another flow control assembly 100 according to the present disclosure in closed configuration 142, while FIG. 5 is a less schematic representation of flow control assembly 100 of FIG. 4 in open configuration 144. In FIGS. 4-5, flow control assembly 100 includes a sliding sleeve 140 that is located external to casing conduit 38. As illustrative, non-exclusive examples, sliding sleeve 140 may be in contact with outer surface 128 of housing body 112, may surround at least a portion of housing body 112, and/or may be located between at least a portion of housing body 112 and subterranean formation 28.

Thus, and when in closed configuration 142, sliding sleeve 140 extends between injection conduits 114 and subterranean formation 28, thereby restricting fluid flow between casing conduit 38 and subterranean formation 28 (as illustrated in FIG. 4). However, and when in open configuration 144, sliding sleeve 140 does not extend between the injection conduits and the subterranean formation, thereby permitting fluid flow between casing conduit 38 and subterranean formation 28 via injection conduits 114 (as illustrated in FIG. 5).

Figure 6:
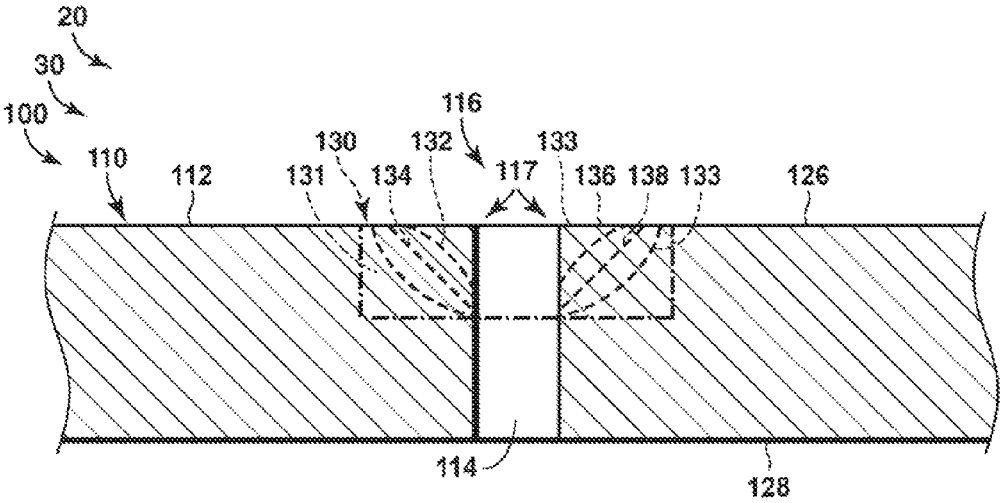
FIG. 6 is a schematic representation of illustrative, non-exclusive examples of a portion of a housing body that includes and/or defines a ball sealer seat and may form a portion of a flow control assembly according to the present disclosure.

FIG. 6 is a schematic representation of illustrative, non-exclusive examples of a portion of a housing 110 that includes and/or defines a ball sealer seat 116 and may form a portion of flow control assemblies 100 according to the present disclosure. Ball sealer seats 116 according to the present disclosure may be specifically configured, designed, machined, sized, and/or selected to form a fluid seal with a ball sealer, when present thereon. As such, a size, shape, and/or material of construction of the ball sealer seat may be selected to permit, encourage, and/or facilitate effective sealing by the ball sealer.

As an illustrative, non-exclusive example, ball sealer seats 116 may include and/or define a ball sealer sealing surface 117 that is specifically configured to form the fluid seal. In contrast to a portion of casing string 30 that may define perforations 60 (as illustrated in FIG. 1), ball sealer sealing surface 117 may include and/or be a smooth surface and/or a regular surface. As an illustrative, non-exclusive example, the ball sealer sealing surface may include and/or be a circular, or at least substantially circular, ball sealer sealing perimeter, edge, surface, or surface region. As additional illustrative, non-exclusive examples, ball sealer sealing surface 117 may include a rounded edge (or edge region) 132, a chamfered, or tapered, edge (or edge region) 134, and/or an edge (or edge region) 133 that is shaped to conform to the shape of the portion of a ball sealer that engages the edge.

It is within the scope of the present disclosure that ball sealer seat 116 may be defined by and/or formed from the same material as housing body 112. Alternatively, it is also within the scope of the present disclosure that ball sealer seat 116 may be defined by and/or formed from a material that is different from, or has a different material composition than, that of housing body 112. As illustrative, non-exclusive examples, ball sealer seat 116 may include and/or be defined by a coating 136 that is operatively attached to housing body 112, a surface treatment 138 of housing body 112, and/or an insert 130 that is operatively attached to housing body 112 and is defined by an insert material 131 that may be different from a material that defines housing body 112.

Additionally or alternatively, it is also within the scope of the present disclosure that ball sealer seat 116 (and/or a material of construction thereof) may be selected to improve formation of the fluid seal with the ball sealer and/or to resist damage during flow of fluid, granular materials, and/or proppant therethrough. As illustrative, non-exclusive examples, the ball sealer seat may include and/or be an erosion-resistant ball sealer seat, a corrosion-resistant ball sealer seat, a hardened ball sealer seat, a resilient ball sealer seat, an elastomeric ball sealer seat, and/or a compliant ball sealer seat. Accordingly, the ball sealer seat may be constructed of, be coated with, be lined with, and/or include (i) a material and/or composition (including, but not limited to, a carbide seat or a carbide insert or engagement surface for a seat) that is harder and/or more resistant to abrasion than the material from which housing body 112 is formed, (ii) a material that is less reactive and/or more resistant to corrosion (in wellbore environments) than the material from which housing body 112 is formed, and/or (iii) a material that is softer and/or more resilient, compressible, and/or compliant than the material from which housing body 112 is formed.

It is within the scope of the present disclosure that ball sealer sealing surface 117 may define any suitable diameter, or inner diameter. As illustrative, non-exclusive examples, the inner diameter of the ball sealer sealing surface may be at least 0.5 centimeters (cm), at least 0.6 cm, at least 0.7 cm, at least 0.8 cm, at least 0.9 cm, at least 1 cm, or at least 1.1 cm. Additionally or alternatively, the inner diameter of the ball sealer sealing surface also may be less than 1.5 cm, less than 1.4 cm, less than 1.3 cm, less than 1.2 cm, less than 1.1 cm, or less than 1 cm. As further non-exclusive examples, the inner diameter of the ball sealer sealing surface may be in a range bounded by any of the preceding non-exclusive examples of minimum and maximum inner diameters.

It is also within the scope of the present disclosure that the inner diameter of the ball sealer sealing surface may be selected relative to an outer diameter of a ball sealer that is configured to form the fluid seal therewith. As illustrative, non-exclusive examples, the inner diameter of the ball sealer sealing surface may be at least 25%, at least 30%, at least 35%, at least 40%, at least 45%, at least 50%, at least 55%, at least 60%, at least 65%, at least 70%, or at least 75% of an outer diameter of the ball sealer. Additionally or alternatively, the inner diameter of the ball sealer sealing surface also may be less than 95%, less than 90%, less than 85%, less than 80%, less than 75%, less than 70%, less than 65%, less than 60%, less than 55%, less than 50%, less than 45%, or less than 40% of the outer diameter of the ball sealer. As further non-exclusive examples, the inner diameter of the ball sealer sealing surface may be in a range bounded by any of the preceding non-exclusive examples of minimum and maximum percentages of the outer diameter of the ball sealer.

Illustrative, non-exclusive examples of outer diameters of ball sealers that may be utilized with the systems and methods according to the present disclosure include outer diameters of at least 1 cm, at least 1.1 cm, at least 1.2 cm, at least 1.3 cm, at least 1.4 cm, at least 1.5 cm, at least 1.6 cm, at least 1.7 cm, at least 1.8 cm, at least 1.9 cm, or at least 2 cm. Additionally or alternatively, the outer diameter of the ball sealers also may be less than 3 cm, less than 2.9 cm, less than 2.8 cm, less than 2.7 cm, less than 2.6 cm, less than 2.5 cm, less than 2.4 cm, less than 2.3 cm, less than 2.2 cm, less than 2.1 cm, or less than 2 cm. As further non-exclusive examples, the outer diameter of the ball sealers may be in a range bounded by any of the preceding non-exclusive examples of minimum and maximum outer diameters.

It is further within the scope of the present disclosure that the inner diameter of the ball sealer sealing surface may be selected relative to an inner diameter of casing conduit 38 that is defined by casing string 30. As illustrative, non-exclusive examples, the inner diameter of the ball sealer sealing surface may be at least 1%, at least 2%, at least 3%, at least 4%, at least 5%, at least 6%, at least 7%, or at least 8% of the inner diameter of the casing conduit. Additionally or alternatively, the inner diameter of the ball sealer sealing surface also may be less than 15%, less than 14%, less than 13%, less than 12%, less than 11%, less than 10%, less than 9%, less than 8%, less than 7%, less than 6%, less than 5%, or less than 4% of the inner diameter of the casing conduit. As further non-exclusive examples, the inner diameter of the ball sealing surface may be in a range bounded by any of the preceding non-exclusive examples of minimum and maximum percentages of the inner diameter of the casing conduit.

FIGS. 7-12 are schematic representations of illustrative, non-exclusive examples of stimulation processes that may be performed in a hydrocarbon well 20 and that may include and/or utilize the systems and methods according to the present disclosure. In FIGS. 7-12, hydrocarbon well 20 includes a casing string 30 that defines a casing conduit 38. Casing string 30 extends within a wellbore 22 that is present within a subterranean formation 28 and includes a plurality of lengths of casing 34 and a plurality of hydraulically actuated flow control assemblies 100 that may be located between respective lengths of casing. Hydrocarbon well 20 also includes an isolation device 56, which fluidly isolates at least a portion of casing conduit 38 from subterranean formation 28.

Flow control assemblies 100 are illustrated schematically in FIGS. 7-12 and include at least a hydraulically actuated sliding sleeve 140 and an injection conduit 114 that is defined at least partially by a ball sealer seat 116. In addition, the flow control assemblies also may include, utilize, and/or be utilized with any of the additional structures that are disclosed herein with reference to any of FIGS. 1-6.

The plurality of flow control assemblies 100 includes at least a first flow control assembly 101 and a second flow control assembly 102. Both first flow control assembly 101 and second flow control assembly 102 may be configured to transition from a closed configuration to an open configuration responsive to a pressure differential. Illustrative, non-exclusive examples of the pressure differential are disclosed herein. However, first flow control assembly 101 may be configured to transition responsive to the pressure differential exceeding a first magnitude, second flow control assembly 102 may be configured to transition responsive to the pressure differential exceeding a second magnitude, and the first magnitude may be less than or otherwise different from the second magnitude. This may permit selective and/or independent transitioning of first flow control assembly 101 and second flow control assembly 102, as discussed herein.

Figure 7:
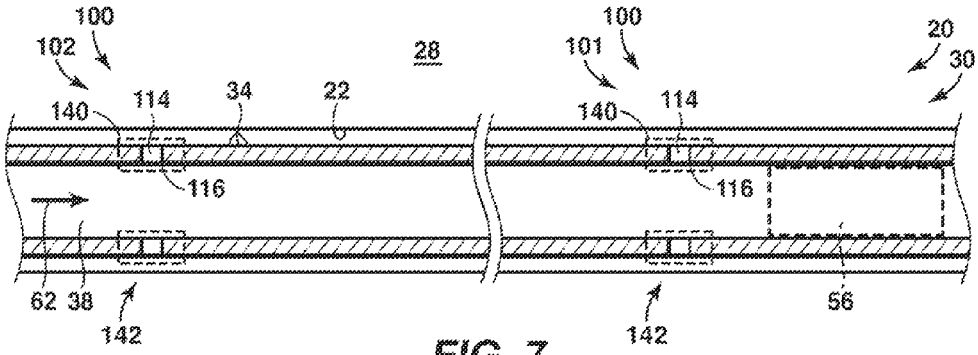
FIG. 7 is a fragmentary schematic representation of illustrative, non-exclusive examples of a stimulation process that may be performed in a hydrocarbon well and that may include and/or utilize the systems and methods according to the present disclosure.
Figure 8:
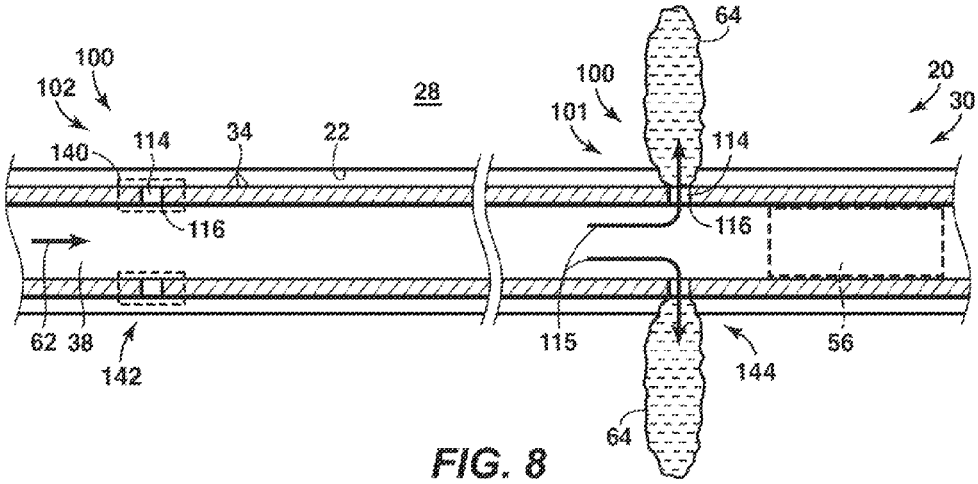
FIG. 8 is another fragmentary schematic representation of illustrative, non-exclusive examples of a stimulation process that may be performed in a hydrocarbon well and that may include and/or utilize the systems and methods according to the present disclosure.

In FIG. 7, sliding sleeves 140 of first flow control assembly 101 and second flow control assembly 102 are in closed configurations 142 and thus resist fluid flow through respective injection conduits 114. Therefore, casing conduit 38 is (at least substantially) fluidly isolated from subterranean formation 28. As also illustrated, a stimulant fluid 62 is provided to casing conduit 38, thereby increasing a pressure within the casing conduit. Subsequent to the pressure differential meeting and/or exceeding the first magnitude, and as illustrated in FIG. 8, sliding sleeve 140 of first flow control assembly 101 transitions to open configuration 144. This is illustrated in FIG. 8 by the absence of sliding sleeve 140 around injection conduit 114 of first flow control assembly 101.

This may permit an injection conduit fluid flow 115 of stimulant fluid 62 to flow through injection conduit(s) 114 of first flow control device 101 into subterranean formation 28. Injection conduit fluid flow 115 may stimulate the subterranean formation, such as by creating one or more stimulated regions 64, which also may be referred to herein as and/or may be fractures 64, therein.

Figure 9:
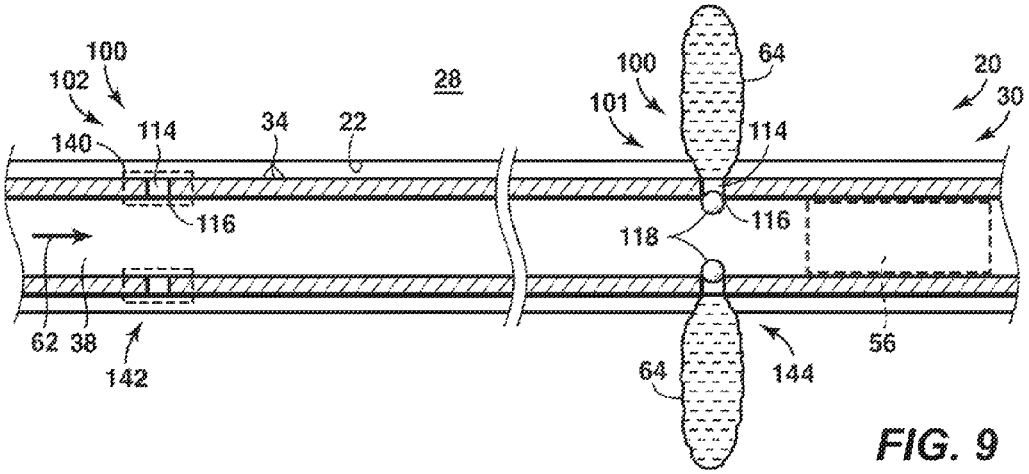
FIG. 9 is another fragmentary schematic representation of illustrative, non-exclusive examples of a stimulation process that may be performed in a hydrocarbon well and that may include and/or utilize the systems and methods according to the present disclosure.
Figure 10:
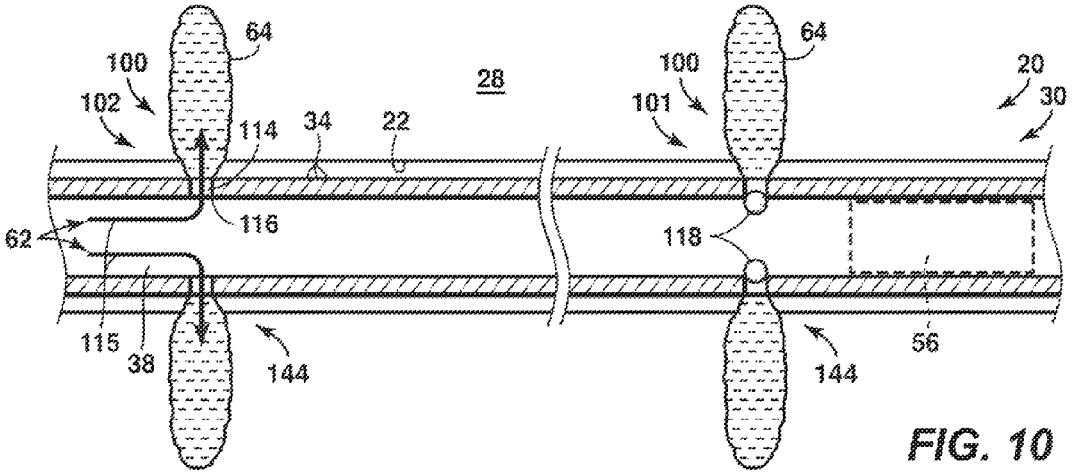
FIG. 10 is another fragmentary schematic representation of illustrative, non-exclusive examples of a stimulation process that may be performed in a hydrocarbon well and that may include and/or utilize the systems and methods according to the present disclosure.

Then, and as illustrated in FIG. 9, one or more ball sealers 118 may be provided to casing conduit 38 (such as by flowing the ball sealers from a surface region and/or within the casing conduit in stimulant fluid 62). These ball sealers may be received on ball sealer seats 116 and may restrict the injection conduit fluid flow, thereby permitting pressurization of casing conduit 38. Subsequent to the pressure differential exceeding the second magnitude, and as illustrated in FIG. 10, sliding sleeve 140 of second flow control assembly 102 may transition to open configuration 144. This may permit injection conduit fluid flow 115 through injection conduit(s) 114 of second flow control device 102 into subterranean formation 28, thereby creating another stimulated region 64. This process may be repeated any suitable number of times with any suitable number of flow control devices 100 to generate any suitable number of stimulated regions 64 within subterranean formation 28. It also is within the scope of the present disclosure that a stimulated region 64 may be re-stimulated, such as through repeated use of flow control devices 100.

Figure 11:
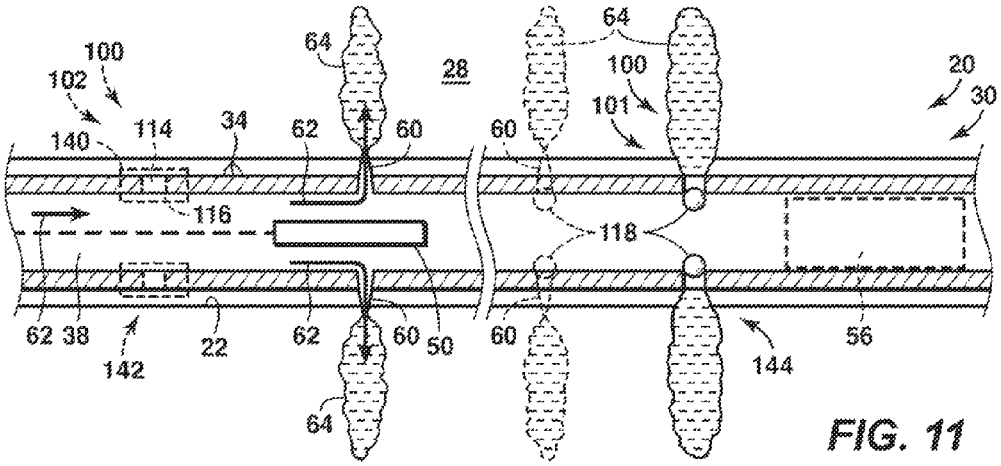
FIG. 11 is another fragmentary schematic representation of illustrative, non-exclusive examples of a stimulation process that may be performed in a hydrocarbon well and that may include and/or utilize the systems and methods according to the present disclosure.

Additionally or alternatively, and as illustrated in FIG. 11, a perforation device 50 also may be utilized to create one or more perforations 60 within casing string 30 and/or to generate one or more additional stimulated regions 64 within subterranean formation 28. As an illustrative, non-exclusive example, and subsequent to first flow control assembly 101 transitioning to open configuration 144 (as illustrated in FIG. 9), perforation device 50 may be flowed into casing conduit 38 with stimulant fluid flow 62 and may be utilized to create one or more perforations uphole from first flow control assembly 101. This may include pressurizing casing conduit 38 with stimulant fluid flow 62, creating one or more perforations 60 within casing string 30 with perforation device 50 (such as responsive to the pressure within casing conduit 38 exceeding a threshold perforating pressure), permitting stimulant fluid flow 62 to enter subterranean formation 28 via perforations 60 to generate stimulated regions 64, and restricting fluid flow through the perforations with ball sealers 118. This process may be repeated any suitable number of times to create any suitable number of perforations within casing string 30 and/or to generate any suitable number of stimulated regions 64.

Figure 12:
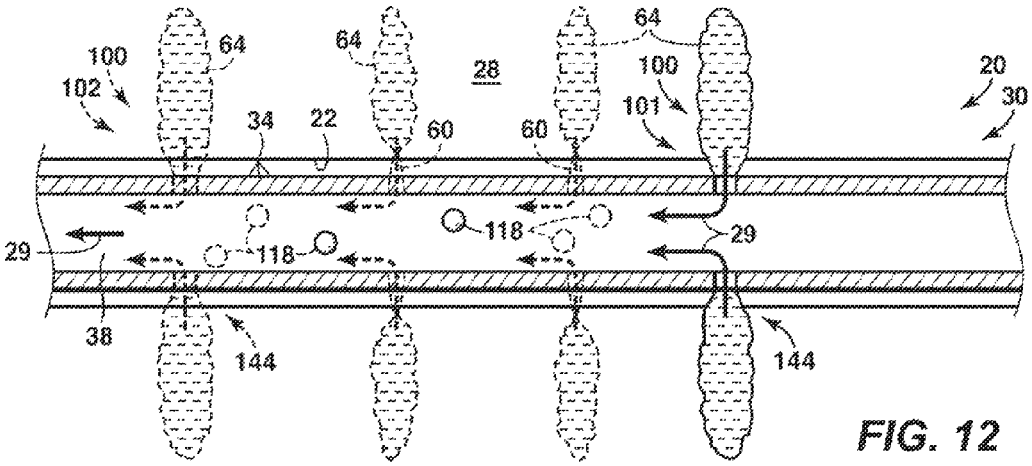
FIG. 12 is another fragmentary schematic representation of illustrative, non-exclusive examples of a stimulation process that may be performed in a hydrocarbon well and that may include and/or utilize the systems and methods according to the present disclosure.

Subsequent to generation of stimulated regions 64 within subterranean formation 28, and as illustrated in FIG. 12, reservoir fluid 29 may be produced from hydrocarbon well 20. This production of reservoir fluid 29 may dislodge, remove, and/or otherwise displace ball sealers 118 from ball sealer seats 116 and/or from perforations 60, thereby permitting the reservoir fluid to enter casing conduit 38 therethrough and/or permitting ball sealers 118 to flow from the casing conduit and/or to the surface region.

FIGS. 1-12 provide illustrative, non-exclusive examples of hydrocarbon wells 20, casing strings 30, flow control assemblies 100, and/or components thereof that may be included in and/or utilized with the systems and methods according to the present disclosure. With this in mind, the following are additional illustrative, non-exclusive examples of components of flow control assemblies 100 according to the present disclosure that may be included in and/or utilized with any of the structures of any of FIGS. 1-12.

Sliding sleeve 140 may be configured to transition between closed configuration 142 and open configuration 144 in any suitable manner. As an illustrative, non-exclusive example, the sliding sleeve may translate when transitioning from the closed configuration to the open configuration. As a more specific but still illustrative, non-exclusive example, casing string 30 and/or casing conduit 38 thereof may define a longitudinal direction, and sliding sleeve 140 may be configured to translate in the longitudinal direction when transitioning between the closed configuration and the open configuration (as illustrated in FIGS. 2-5 and discussed herein). As another more specific but still illustrative, non-exclusive example, sliding sleeve 140 may translate in downhole direction 40 when transitioning between the closed configuration and the open configuration.

It is within the scope of the present disclosure that, when in closed configuration 142, sliding sleeve 140 may be in contact with, may cover, and/or may occlude injection conduits 114 and/or ball sealer seats 116 thereof. This may include the sliding sleeve being located between casing conduit 38 and injection conduits 114 and/or ball sealer seats 116 (as illustrated in FIGS. 2-3) and/or being located between injection conduits 114 and subterranean formation 28 (as illustrated in FIGS. 4-5). However, and upon transitioning to open configuration 144, sliding sleeve 140 may be located downhole (or uphole) from injection conduits 114 and/or from ball sealer seats 116.

It is also within the scope of the present disclosure that sliding sleeve 140 may not be configured to transition between closed configuration 142 and open configuration 144 responsive to and/or based upon a stimulus other than (or in addition to) the pressure differential. As illustrative, non-exclusive examples, the sliding sleeve may not transition responsive to mechanical contact between the sliding sleeve and another structure, receipt of an electrical stimulus, receipt of a mechanical force, and/or motion of a mechanical actuator.

Injection conduits 114 may be any suitable fluid conduit that is defined by housing 110, housing body 112, and/or ball sealer seat 116, that is configured to permit fluid flow therethrough when the ball sealer is not present on the ball sealer seat and/or when sliding sleeve 140 is in open configuration 144, and that is configured to restrict fluid flow from the casing conduit therethrough when the ball sealer is located on the ball sealer seat and/or when the sliding sleeve is in closed configuration 142. As discussed, the systems and methods disclosed herein may include stimulating a subterranean formation by flowing a stimulant fluid through the injection conduit and into the subterranean formation. As such, a cross-sectional area of injection conduits 114 may be selected to permit and/or facilitate stimulation of the subterranean formation.

This may include selecting the cross-sectional area of the injection conduits to maintain at least a threshold pressure drop thereacross when the stimulant fluid flows therethrough, to maintain a positive net pressure within the casing conduit when the stimulant fluid flows through the injection conduit, and/or to maintain at least a threshold stimulant fluid velocity when the stimulant fluid flows through the injection conduit. The threshold pressure drop and/or the positive net pressure may be selected to (or to be sufficient to) retain ball sealers on occluded ball sealer seats during the stimulating (as illustrated in FIG. 10).

FIGS. 1-12 illustrate flow control assemblies 100 that include various numbers of injection conduits 114. It is within the scope of the present disclosure that the flow control assembly may include a single injection conduit 114 or a plurality of injection conduits 114 that may be at least partially defined by a single or a respective plurality of ball sealer seats 116. As illustrative, non-exclusive examples, flow control assemblies 100 may include at least 2, at least 4, at least 6, at least 8, at least 10, at least 12, at least 14, or at least 16 ball sealer seats and a corresponding number of injection conduits 114. Additionally or alternatively, flow control assemblies 100 also may include fewer than 24, fewer than 22, fewer than 20, fewer than 18, fewer than 16, fewer than 14, fewer than 12, fewer than 10, or fewer than 8 ball sealer seats and a corresponding number of injection conduits 114. When two or more ball sealer seats 116 are present in/on a flow control assembly 100, the seats may be spaced in any suitable relative spacing, including axially and/or radially around/along housing body 112. However, the seats should be spaced sufficiently from each other to permit effective locating and sealing of ball sealers on each of the seats so that fluid flow through all of the corresponding injection conduits may be restricted or blocked simultaneously by ball sealers 118.

When flow control assembly 100 includes a plurality of ball sealer seats 116, it is within the scope of the present disclosure that the plurality of ball sealer seats may define any suitable total flow area (or total cross-sectional area). As illustrative, non-exclusive examples, the total flow area may be at least 4 square centimeters, at least 6 square centimeters, at least 8 square centimeters, at least 10 square centimeters, at least 12 square centimeters, at least 14 square centimeters, at least 16 square centimeters, at least 18 square centimeters, at least 20 square centimeters, at least 22 square centimeters, at least 24 square centimeters, or at least 26 square centimeters. Additionally or alternatively, the total flow area also may be less than 60 square centimeters, less than 55 square centimeters, less than 50 square centimeters, less than 45 square centimeters, less than 40 square centimeters, less than 35 square centimeters, less than 30 square centimeters, less than 25 square centimeters, less than 20 square centimeters, less than 18 square centimeters, less than 16 square centimeters, less than 14 square centimeters, or less than 12 square centimeters. As further non-exclusive examples, the total flow area may be in a range that is bounded by any of the preceding non-exclusive examples of minimum and maximum total flow areas.

When flow control assemblies 100 form a portion of casing strings 30 that include perforations 60, it is within the scope of the present disclosure that a cross-sectional area of injection conduits 114 (or of ball sealer seats 116) may be within a threshold percentage of a cross-sectional area of perforations 60. As discussed with reference to FIGS. 1 and 7-12, the systems and methods disclosed herein may include stimulating subterranean formation 28 by flowing stimulant fluid 62 through both perforations 60 and injection conduits 114. As such, matching the cross-sectional area of the injection conduits to the cross-sectional area of the perforations to within the threshold percentage may permit the use of equivalent, at least substantially equivalent, and/or similar flow rates of stimulant fluid 62 during stimulation of the subterranean formation via the perforations and the injection conduits. Illustrative, non-exclusive examples of threshold percentages according to the present disclosure include threshold percentages of less than 50%, less than 45%, less than 40%, less than 35%, less than 30%, less than 25%, less than 20%, less than 15%, less than 10%, or less than 5% of the cross-sectional area of the perforation.

Isolation device 56, which is illustrated in FIGS. 1 and 7-12, may include any suitable structure that may be configured to fluidly isolate at least a portion of casing conduit 38 from subterranean formation 28 and/or to fluidly isolate at least a portion of casing conduit 38 from a remainder of the casing conduit. As an illustrative, non-exclusive example, and as illustrated in FIG. 1, isolation device 56 may be located at, near, and/or proximal to terminal end 42 of casing string 30 and may fluidly isolate a majority (or substantially all) of the casing conduit from the subterranean formation. As another illustrative, non-exclusive example, isolation device 56 may be located uphole from terminal end 42.

An illustrative, non-exclusive example of isolation device 56 includes an isolation ball 148 and corresponding isolation ball seat 146. Isolation ball seat 146 may extend within casing conduit 38 and may be configured to receive isolation ball 148 thereon, to form a fluid seal with the isolation ball, and/or to restrict fluid flow between a portion of casing conduit 38 that is uphole from isolation device 56 and a portion of the casing conduit that is downhole from the isolation device.

An additional illustrative, non-exclusive example of isolation device 56 includes ball sealers 118. In this context, ball sealers 118 may be configured to form a fluid seal with perforations 60 and/or with ball sealer seats 116 of injection conduits 114, thereby restricting flow between casing conduit 38 and subterranean formation 28. Another illustrative, non-exclusive example of isolation device 56 is a plug 58, which also may be referred to herein as, and/or may be, a bridge plug 58.

Isolation ball seat 146, when present, may include any suitable structure that may be configured to receive isolation ball 148 and to form a fluid seal therewith. As an illustrative, non-exclusive example, isolation ball seat 146 may include and/or be a machined isolation ball seat. As another illustrative, non-exclusive example, isolation ball seat 146 may define an isolation ball sealing surface that is configured to form the fluid seal with isolation ball 148. The isolation ball sealing surface may include any suitable property and/or may define any suitable shape and/or structure, illustrative, non-exclusive examples of which are discussed herein with reference to ball sealer sealing surface 117. Isolation ball seat 146 also may be referred to herein as and/or may be an isolation seat 146, an isolation surface 146, a designated isolation surface 146, a designed isolation surface 146, an isolation body receptacle 146, an isolation device receptacle 146, and/or an isolation structure receptacle 116. Similarly, isolation ball 148 also may be referred to herein as and/or may be an isolation device 148, an isolation unit 148, an isolation body 148, and/or an isolation structure 148.

The illustrative, non-exclusive examples of hydrocarbon wells 20, casing strings 30, and/or flow control assemblies 100 that are disclosed herein have been discussed in the context of a ball sealer 118 that is configured to seal a ball sealer seat 116 that is defined by flow control assembly 100. However, it is within the scope of the present disclosure that flow control assemblies 100 may be utilized with any suitable sealing structure that may be configured to selectively permit and/or restrict fluid flow through injection conduits 114. With this in mind, ball sealer seat 116 also may be, and/or may be referred to herein as, a sealing seat 116, a sealing surface 116, a designated sealing surface 116, a designed sealing surface 116, a sealing body receptacle 116, a sealing device receptacle 116, a sealing unit receptacle 116, and/or a sealing structure receptacle 116. Similarly, ball sealer 118 also may be referred to herein as, and/or may be, a sealing device 118, a sealing unit 118, a sealing body 118, and/or a sealing structure 118.

Figure 13:
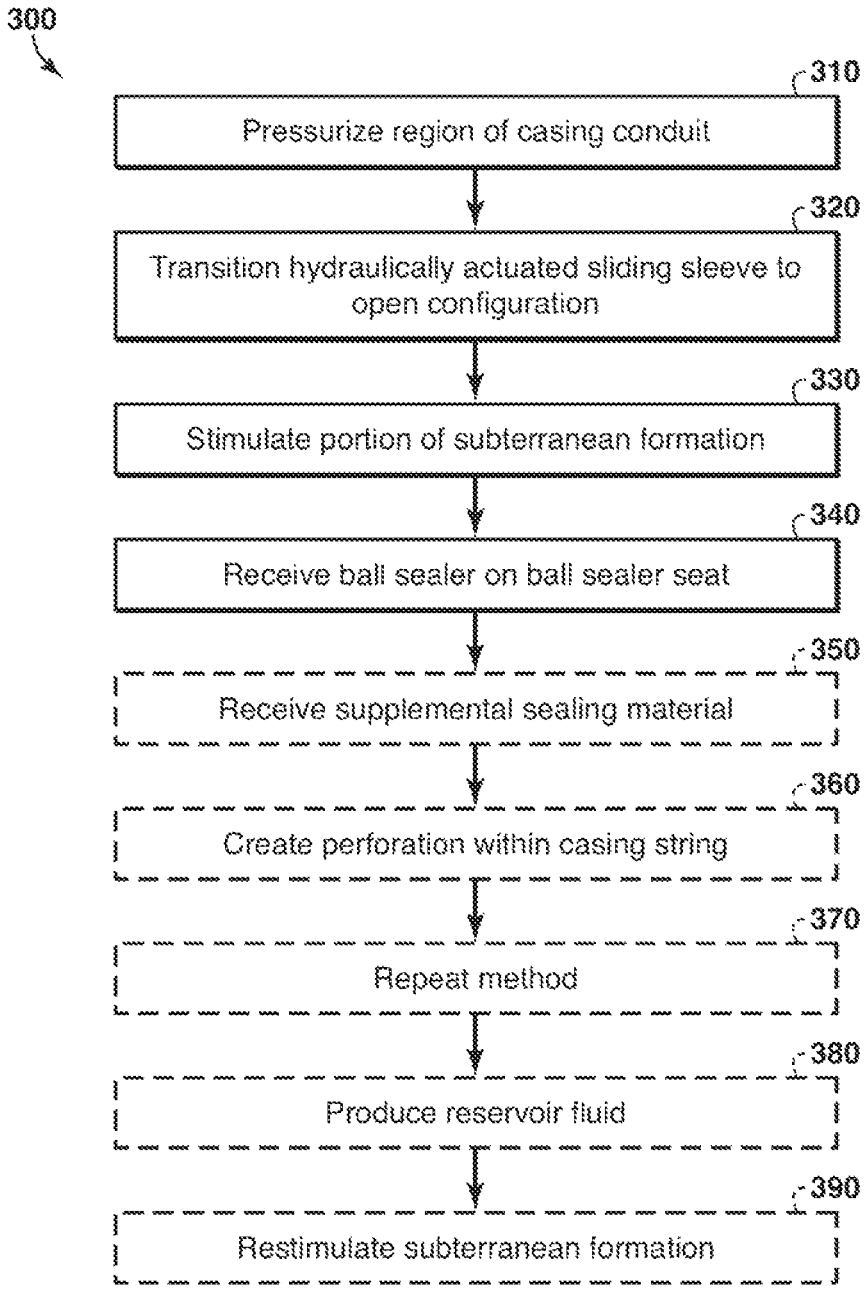
FIG. 13 is a flowchart depicting methods according to the present disclosure of stimulating a subterranean formation.

FIG. 13 is a flowchart depicting methods 300 according to the present disclosure of stimulating a subterranean formation. Methods 300 include pressurizing a region of a casing conduit at 310 and transitioning a hydraulically actuated sliding sleeve to an open configuration at 320. Methods 300 further include stimulating a portion of a subterranean formation at 330 and receiving a ball sealer on a ball sealer seat at 340. Methods 300 further may include receiving a supplemental sealing material at 350, creating a perforation within a casing string at 360, repeating at least a portion of the methods at 370, producing a reservoir fluid at 380, and/or re-stimulating at least a portion of the subterranean formation at 390.

Pressurizing the region of the casing conduit at 310 may include pressurizing any suitable portion of the casing conduit, which is defined at least partially by the casing string. This may include pressurizing to generate a pressurized region within the casing conduit. At least a portion of the pressurized region may be defined by a flow control assembly. The flow control assembly includes the hydraulically actuated sliding sleeve and an injection conduit, which extends between the casing conduit and the subterranean formation.

As an illustrative, non-exclusive example, the pressurizing at 310 may include generating a pressure differential. This may include generating the pressure differential between the casing conduit and the subterranean formation and/or generating the pressure differential between the pressurized region of the casing conduit and a portion of the casing conduit that is downhole from the hydraulically actuated flow control assembly, which also may be referred to herein as a downhole portion of the casing conduit.

It is within the scope of the present disclosure that the pressurizing at 310 further may include fluidly isolating the pressurized region to permit pressurization thereof. This may be accomplished in any suitable manner and may include fluidly isolating the pressurized region from the downhole portion of the casing conduit and/or fluidly isolating the pressurized region from the subterranean formation. As illustrative, non-exclusive examples, the fluidly isolating may include locating an isolation device within the casing conduit, providing a pressurizing ball sealer to the casing conduit, receiving the pressurizing ball sealer on an open ball sealer seat, providing an isolation ball to the casing conduit, and/or receiving the isolation ball on an isolation ball seat.

As another illustrative, non-exclusive example, the pressurizing at 310 also may include providing a stimulant fluid to the casing conduit, such as by pumping the stimulant fluid into the uphole portion of the casing conduit. Illustrative, non-exclusive examples of the stimulant fluid include water, a foam, an acid, and/or a proppant. The providing at 310 may include maintaining a positive net pressure within the casing conduit. Additionally or alternatively, the providing at 310 also may include continuously, or at least substantially continuously, providing the stimulant fluid during a remainder of methods 300. This may include providing the stimulant fluid during at least 75%, at least 80%, at least 85%, at least 90%, at least 95%, at least 97.5%, at least 99%, or 100% of a time period during which methods 300 are performed.

Transitioning the hydraulically actuated sliding sleeve to the open configuration at 320 may include transitioning responsive to the pressure differential exceeding a threshold pressure differential. This may include transitioning the hydraulically actuated sliding sleeve from a closed configuration, in which the hydraulically actuated sliding sleeve resists an injection conduit fluid flow from the casing conduit through the injection conduit and into the subterranean formation, to the open configuration, in which the hydraulically actuated sliding sleeve permits the injection conduit fluid flow from the casing conduit through the injection conduit and into the subterranean formation. As illustrative, non-exclusive examples, the transitioning at 320 may include translating the hydraulically actuated sliding sleeve within the casing conduit, along an outer surface of the flow control assembly, along a longitudinal axis of the casing conduit, and/or in a downhole direction.

Stimulating the portion of the subterranean formation at 330 may include stimulating by flowing the stimulant fluid through the injection conduit and into the subterranean formation as the injection conduit fluid flow. As illustrative, non-exclusive examples, the stimulating at 330 may include fracturing the portion of the subterranean formation, dissolving a fraction of the portion of the subterranean formation, and/or increasing a fluid permeability of the portion of the subterranean formation. It is within the scope of the present disclosure that the stimulating at 330 may be performed at any suitable time and/or with any suitable sequence within methods 300. As illustrative, non-exclusive examples, the stimulating at 330 may be subsequent to the pressurizing at 310, subsequent to the transitioning at 320, and/or (directly) responsive to the transitioning at 320.

Receiving the ball sealer on the ball sealer seat at 340 may include receiving the ball sealer to restrict the injection conduit fluid flow from the casing conduit into the subterranean formation. This may include receiving the ball sealer on any suitable ball sealer seat that is defined by the flow control assembly and that defines at least a portion of the injection conduit. Additionally or alternatively, the receiving at 340 also may include forming a fluid seal between the ball sealer and the ball sealer seat and/or fluidly isolating the casing conduit from the subterranean formation.

It is within the scope of the present disclosure that the receiving at 340 further may include providing the ball sealer to an uphole portion of the casing conduit and flowing the ball sealer into contact with the ball sealer seat. This may include flowing the ball sealer with the stimulant fluid that may be provided during the pressurizing at 310. It is also within the scope of the present disclosure that the receiving at 340 may be performed at any suitable time and/or with any suitable sequence within methods 300. As illustrative, non-exclusive examples, the receiving at 340 may be performed subsequent to the pressurizing at 310, at least partially concurrently with the pressurizing at 310, subsequent to the transitioning at 320, and/or subsequent to the stimulating at 330.

Receiving the supplemental sealing material at 350 may include receiving any suitable supplemental sealing material with, near, and/or proximal to the flow control assembly and/or the ball sealer. This may include establishing physical and/or mechanical contact between the supplemental sealing material and the ball sealer and/or the flow control assembly. Illustrative, non-exclusive examples of the supplemental sealing material are disclosed herein.

Creating the perforation within the casing string at 360 may include creating any suitable perforation within any suitable portion of the casing string and may be performed at any suitable time and/or with any suitable sequence within methods 300. As an illustrative, non-exclusive example, the creating at 360 may include creating the perforation with a perforation device.

When methods 300 include the creating at 360, the methods further may include stimulating the subterranean formation through, or via, the perforation. This may be at least substantially similar to the stimulating at 330 but may include flowing the stimulant fluid through the perforation to stimulate the subterranean formation.

Additionally or alternatively, and when methods 300 include the creating at 360, the methods also may include limiting, blocking, and/or occluding fluid flow through the perforation. This may include locating a ball sealer on the perforation.

Repeating at least a portion of the methods at 370 may include repeating any suitable portion of methods 300. As an illustrative, non-exclusive example, the repeating at 300 may include repeating to re-stimulate the subterranean formation and/or any suitable portion thereof. This may include repeating prior to the producing at 380 and/or subsequent to the producing at 380.

As a more specific but still illustrative, non-exclusive example, the hydraulically actuated flow control assembly may be a first hydraulically actuated flow control assembly that includes a first injection conduit, a first ball sealer seat, and a first hydraulically actuated sliding sleeve. The first hydraulically actuated sliding sleeve may be configured to transition from the closed configuration to the open configuration responsive to the pressure differential exceeding a first threshold pressure differential and to stimulate a first portion of the subterranean formation. Under these conditions, and subsequent to the receiving at 340, the repeating at 370 may include repeating the pressurizing at 310, such as to pressurize a second portion of the casing conduit.

Then, the repeating at 370 may include repeating the transitioning at 320 to transition a second hydraulically actuated sliding sleeve, which is associated with a second hydraulically actuated flow control assembly, from the closed configuration to the open configuration responsive to the pressure differential exceeding a second threshold pressure differential that is greater than the first threshold pressure differential. Subsequently, the repeating at 370 may include repeating the stimulating at 330 to stimulate a second portion of the subterranean formation, which may be different from and/or spaced apart from the first portion of the subterranean formation, by flowing the stimulant fluid through the second injection conduit. Then, the repeating at 370 may include repeating the receiving at 340 to receive a second ball sealer on a second ball sealer seat that defines a portion of the second injection conduit and to restrict fluid flow from the casing conduit through the second injection conduit and into the subterranean formation.

It is within the scope of the present disclosure that the first hydraulically actuated flow control assembly and the second hydraulically actuated flow control assembly may define any suitable relative orientation within the casing string. As an illustrative, non-exclusive example, the first hydraulically actuated flow control assembly may be uphole from the second hydraulically actuated flow control assembly. As another illustrative, non-exclusive example, the first hydraulically actuated flow control assembly may be downhole from the second hydraulically actuated flow control assembly.

It is also within the scope of the present disclosure that the repeating at 370 may include repeating any suitable number of times. This may include repeating to sequentially transition a plurality of hydraulically actuated flow control assemblies from respective closed configurations to respective open configurations to thereby permit injection conduit fluid flows through respective injection conduits responsive to the pressure differential exceeding respective threshold pressure differentials. This also may include sequentially stimulating a plurality of respective portions of the subterranean formation that may be associated with the respective hydraulically actuated sliding sleeves and/or sequentially receiving a respective ball sealer on a respective ball sealer seat that may define a portion of the respective injection conduit.

Additionally or alternatively, it is also within the scope of the present disclosure that the repeating at 370 may include performing (or repeating) the creating at 360. As an illustrative, non-exclusive example, and subsequent to the receiving at 340, the repeating at 370 may include repeating the pressurizing at 310 and then performing (or repeating) the creating at 360 to create the perforation within the casing conduit. Subsequently, the repeating at 370 further may include stimulating the subterranean formation via the perforation and receiving a ball sealer on the perforation to restrict fluid flow through the perforation. When the repeating at 370 includes the creating at 360, it is within the scope of the present disclosure that the creating at 360 may include creating the perforation in a portion of the casing string that is uphole from the hydraulically actuated flow control assembly. Additionally or alternatively, it is also within the scope of the present disclosure that the creating at 360 may include creating the perforation in a portion of the casing string that is downhole from the hydraulically actuated flow control assembly.

Producing the reservoir fluid at 380 may include producing the reservoir fluid from the subterranean formation through, or via, the casing conduit. This may include flowing the reservoir fluid from the subterranean formation into the casing conduit, such as via any suitable injection conduit and/or perforation that may extend between the casing conduit and the subterranean formation. This also may include flowing the reservoir fluid through the casing conduit from the subterranean formation to, or near, a surface region. When methods 300 include the producing at 380, it is within the scope of the present disclosure that methods 300 further may include transitioning from the stimulating at 330 to the producing at 380 without removing a bridge plug from the casing conduit.

While not required, it is within the scope of the present disclosure that flow control assemblies 100 with a hydraulically actuated sliding sleeve 140 may be utilized to re-stimulate a subterranean formation after production of reservoir fluids through casing conduit 38 (such as via the producing 380). In particular, conventional sliding sleeves that do not include ball sealer seats 116 inhibit such a re-stimulation process because injection conduits between the casing conduit and the subterranean formation remain open after the sleeve is transitioned to its open configuration. Without an effective mechanism to at least temporarily seal these injection conduits, it is difficult to re-stimulate the subterranean formation via the casing conduit except through the use of coiled tubing and/or similar devices for delivering pressurized stimulant fluid directly to a specific injection conduit.

In contrast, ball sealer seats 116 of hydraulically actuated sliding sleeves 140 and/or flow control assemblies 100 according to the present disclosure overcome this challenge because they may be (re)sealed with ball sealers 118 to inhibit or otherwise prevent fluid flow between the casing conduit and the subterranean formation, even after production of reservoir fluids through the corresponding injection conduits 114. Therefore, if there is a desire to re-stimulate a region of the subterranean formation through casing conduit 38, production of reservoir fluids may be interrupted and stimulant fluid 62 may be pumped into the casing conduit. This stimulant fluid will flow through one or more injection conduits 114 into the subterranean formation to re-stimulate corresponding regions of the subterranean formation. This flow of stimulant fluid will be greatest in regions of the subterranean formation that have greatest permeability and/or least resistance to fluid flow therethrough (i.e., are "weakest"). To increase the effectiveness of the injected stimulant fluid to re-stimulate other regions of the subterranean formation, ball sealers 118 may be placed into the casing conduit. These ball sealers will flow with the stimulant fluid and will land or otherwise seat on the corresponding ball sealer seats through which this greatest flow of stimulant fluid to the subterranean formation is occurring, thereby preventing stimulant fluid flow through the corresponding injection conduits. Once the ball sealers are seated on the corresponding ball sealer seats, the injected stimulant fluid will flow through other injection conduits (such as the conduits that are proximate the regions of the subterranean formation with the next greatest permeability (i.e., the next weakest regions) to restimulate other regions of the subterranean formation. This process may be repeated, as desired.

Because the injection conduits associated with the ball sealer seats of hydraulically actuated sliding sleeve 140 also may be (re)sealed with ball sealers, the re-stimulation process is not inhibited by the use of hydraulically actuated sliding sleeve 140 after the sleeve has been slid or otherwise transitioned to its open configuration. Instead, ball sealers may be used to obstruct flow through the injection conduits that are opened by the sliding/transitioning of the sleeve. This optional re-stimulation process is indicated schematically in FIG. 13 at 390.

Methods 300 that are disclosed herein may permit more efficient stimulation of the subterranean formation when compared to more traditional stimulation operations that may utilize a bridge plug to regulate fluid flows within the casing conduit. With this in mind, it is within the scope of the present disclosure that methods 300 may be performed without setting a bridge plug within the casing conduit.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A flow control assembly that is configured to control a fluid flow between a subterranean formation and a casing conduit of a casing string, the assembly comprising:

a housing that includes:

a housing body with an inner surface that defines at least a portion of a casing conduit that extends within the subterranean formation;

an injection conduit that extends through the housing body between the casing conduit and the subterranean formation; and a ball sealer seat that defines a portion of the injection conduit and is sized to receive a ball sealer to restrict fluid flow from the casing conduit through the injection conduit; and a hydraulically actuated sliding sleeve located external to the housing conduit and that is configured to transition, responsive to a pressure differential, between a closed configuration, in which the hydraulically actuated sliding sleeve resists an injection conduit fluid flow from the casing conduit through the injection conduit to the subterranean formation, and an open configuration, in which the hydraulically actuated sliding sleeve permits the injection conduit fluid flow from the casing conduit through the injection conduit to the subterranean formation.

2. The assembly of claim 1, wherein the pressure differential includes a pressure differential between the subterranean formation and the casing conduit, and further wherein the pressure differential includes a pressure within the casing conduit being greater than a pressure within the subterranean formation.

3. The assembly of claim 1, wherein the hydraulically actuated sliding sleeve is at least one of located within the casing conduit, in contact with the inner surface of the housing body, and located within the portion of the casing conduit that is defined by the inner surface of the housing body.

4. The assembly of claim 3, wherein, when in the closed configuration, the hydraulically actuated sliding sleeve fluidly isolates the ball sealer seat from the casing conduit, and further wherein, in the open configuration, the hydraulically actuated sliding sleeve permits fluid communication between the ball sealer seat and the casing conduit.

5. The assembly of claim 1, wherein the hydraulically actuated sliding sleeve surrounds at least a portion of the housing body, is in contact with an outer surface of the housing body that is opposed to the inner surface of the housing body, and is located between at least the portion of the housing body and the subterranean formation.

6. The assembly of claim 1, wherein the flow control assembly further includes a retention structure that is configured to retain the hydraulically actuated sliding sleeve in the closed configuration and to selectively permit the hydraulically actuated sliding sleeve to transition to the open configuration responsive to the pressure differential.

7. The assembly of claim 1, wherein a cross-sectional area of the injection conduit is sized to permit stimulation of the subterranean formation when a stimulant fluid flows from the casing conduit, through the injection conduit, and into the subterranean formation.

8. The assembly of claim 1, wherein the injection conduit is sized to maintain at least a threshold pressure drop thereacross when a stimulant fluid flows from the casing conduit, through the injection conduit, and into the subterranean formation, wherein the threshold pressure drop is selected to retain a seated ball sealer on an occluded ball sealer seat during the stimulant fluid flow.

9. The assembly of claim 1, wherein the injection conduit is a first injection conduit, wherein the ball sealer seat is a first ball sealer seat, and further wherein the housing includes a plurality of injection conduits and a plurality of respective ball sealer seats.

10. The assembly of claim 1, wherein the ball sealer seat defines a ball sealer sealing surface that is configured to form a fluid seal with the ball sealer, and further wherein the ball sealer sealing surface is a circular, or at least substantially circular, ball sealer sealing surface.

11. The assembly of claim 1, wherein the ball sealer seat is a machined ball sealer seat.

12. The assembly of claim 1, wherein a material composition of the ball sealer seat is different from a material composition of the housing body.

13. The assembly of claim 1, wherein the ball sealer seat includes at least one of an erosion-resistant ball sealer seat, a corrosion-resistant ball sealer seat, a hardened ball sealer seat, a resilient ball sealer seat, an elastomeric ball sealer seat, and a compliant ball sealer seat.

14. The assembly of claim 1, wherein the ball sealer seat is defined on at least one of a chamfered surface, a tapered surface, and a rounded surface.

15. A casing string that defines a casing conduit and is configured to extend within a subterranean formation, the casing string comprising:

a plurality of lengths of casing; and a plurality of the flow control assemblies of claim 1 that are spaced apart along a length of the casing string.

16. The casing string of claim 15, wherein the plurality of flow control assemblies includes a first flow control assembly, which includes a first hydraulically actuated sliding sleeve that is configured to transition between a closed configuration and an open configuration responsive to a pressure differential exceeding a first magnitude, and a second flow control assembly, which includes a second hydraulically actuated sliding sleeve that is configured to transition between the closed configuration and the open configuration responsive to the pressure differential exceeding a second magnitude, wherein the first flow control assembly is downhole from the second flow control assembly, and further wherein the first magnitude is less than the second magnitude.

17. A hydrocarbon well, comprising:

a wellbore that extends between a surface region and a subterranean formation; and the casing string of claim 15, wherein the casing string extends within the wellbore.

18. A method of stimulating a subterranean formation, the method comprising:

pressurizing a region of a casing conduit with a stimulant fluid to generate a pressurized region within the casing conduit, wherein at least a portion of the pressurized region is defined by a flow control assembly that includes a hydraulically actuated sliding sleeve and an injection conduit that extends between the casing conduit and the subterranean formation;

transitioning, responsive to a pressure differential exceeding a threshold pressure differential, the hydraulically actuated sliding sleeve from a closed configuration, in which the hydraulically actuated sliding sleeve resists an injection conduit fluid flow from the casing conduit through the injection conduit to the subterranean formation, to an open configuration, in which the hydraulically actuated sliding sleeve permits the injection conduit fluid flow from the casing conduit through the injection conduit to the subterranean formation, wherein the transitioning includes translating the hydraulically actuated sliding sleeve along an outer surface of the flow control assembly;

stimulating a portion of the subterranean formation by flowing the stimulant fluid through the injection conduit and into the subterranean formation as the injection conduit fluid flow; and receiving a ball sealer on a ball sealer seat that defines a portion of the injection conduit to restrict the injection conduit fluid flow from the casing conduit through the injection conduit and into the subterranean formation.

19. The method of claim 18, wherein the pressurizing includes generating the pressure differential between the pressurized region of the casing conduit and the subterranean formation.

20. The method of claim 18, wherein the transitioning includes translating the hydraulically actuated sliding sleeve within the casing conduit.

21. The method of claim 18, wherein the pressurizing includes providing the stimulant fluid to the casing conduit.

22. The method of claim 18, wherein the stimulating includes at least one of:

(i) fracturing the portion of the subterranean formation;

(ii) dissolving a fraction of the portion of the subterranean formation; and (iii) increasing a fluid permeability of the portion of the subterranean formation.

23. The method of claim 18, wherein the receiving the ball sealer includes forming a fluid seal between the ball sealer and the ball sealer seat.

24. The method of claim 18, wherein the method further includes producing a reservoir fluid from the subterranean formation, and further wherein the method includes transitioning from the stimulating to the producing without removing a bridge plug from the casing conduit.

25. The method of claim 18, wherein the hydraulically actuated sliding sleeve is a first hydraulically actuated sliding sleeve that is configured to transition from the closed configuration to the open configuration responsive to the pressure differential exceeding a first threshold pressure differential, wherein the injection conduit is a first injection conduit, wherein the portion of the subterranean formation is a first portion of the subterranean formation, and further wherein, subsequent to the receiving, the method further includes:

repeating the pressurizing;

transitioning a second hydraulically actuated sliding sleeve from the closed configuration to the open configuration to permit fluid flow through a second injection conduit responsive to the pressure differential exceeding a second threshold pressure differential that is greater than the first threshold pressure differential; and stimulating a second portion of the subterranean formation that is spaced apart from the first portion of the subterranean formation by flowing the stimulant fluid through the second injection conduit.

26. The method of claim 25, wherein, subsequent to the receiving, the method further includes:

repeating the pressurizing;

creating a perforation in a casing string that defines the casing conduit with a perforation device;

stimulating a subsequent portion of the subterranean formation by flowing the stimulant fluid through the perforation; and receiving a subsequent ball sealer on the perforation to restrict flow of the stimulant fluid from the casing conduit through the perforation and into the subterranean formation.

* * * * *